US006729366B2

(12) United States Patent
Tanaka et al.

(10) Patent No.: US 6,729,366 B2
(45) Date of Patent: May 4, 2004

(54) FLOW METER TYPE LIQUID FILLING APPARATUS

(75) Inventors: Namiyoshi Tanaka, Iwakuni (JP); Hiroyuki Okazaki, Iwakuni (JP); Shoichi Koga, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 10/192,093

(22) Filed: Jul. 10, 2002

(65) Prior Publication Data

US 2003/0010398 A1 Jan. 16, 2003

(30) Foreign Application Priority Data

Jul. 10, 2001 (JP) ..... 2001-208701
May 15, 2002 (JP) ..... 2002-140761

(51) Int. Cl.[7] ..... B65B 1/30

(52) U.S. Cl. ..... 141/94; 141/286; 141/144; 141/192

(58) Field of Search ..... 141/94, 286, 236, 141/18, 21, 144, 192; 222/399, 138, 23, 71

(56) References Cited

U.S. PATENT DOCUMENTS 6,148,876 A * 11/2000 Corniani et al. ..... 141/84
6,592,825 B2 * 7/2003 Pelc et al. ..... 422/100

FOREIGN PATENT DOCUMENTS

| | | | |
|---|---|---|---|
| DE | 28 48 988 | | 5/1980 |
| EP | 0 274 338 | | 7/1988 |
| EP | 1275612 A1 | * | 1/2003 |
| JP | 11-105987 | | 4/1999 |
| JP | 11193094 | * | 7/1999 |
| JP | 2000-190922 | | 7/2000 |

* cited by examiner

*Primary Examiner*—Gregory L. Huson
*Assistant Examiner*—Khoa D. Huynh
(74) *Attorney, Agent, or Firm*—Koda & Androlia

(57) ABSTRACT

A rotary and flow meter type liquid filling apparatus including a liquid reservoir tank that stores and supplies liquid to filling nozzles, and air supply paths for different amount of air supply and air discharge paths for different amount of air discharge being connected to the liquid reservoir tank. An air compressor is connected to the air supply paths, and the air discharge paths open into the atmosphere. A liquid pressure sensor disposed near the filling nozzles sense the increase or decrease of the liquid pressure inside a pipe that connects the liquid reservoir tank and liquid filling nozzles, and the electromagnetic valves provided on the air supply and air discharge paths are opened or closed, thus supplying air to and discharging air from the liquid reservoir tank so as to control the air pressure inside the liquid reservoir tank and the liquid pressure near the liquid filling nozzles.

4 Claims, 6 Drawing Sheets

FLOW METER TYPE LIQUID FILLING APPARATUS

BACKGROUND OF THE INVENTION

1. Field of the Invention

The invention relates to a liquid filling apparatus and more particularly to an improvement in an apparatus that fills containers with liquid and is provided with liquid flow meters.

2. Prior Art

Liquid filling apparatuses that fill containers with liquid have been known, and one type thereof is a flow meter type liquid filling apparatus.

A typical flow type liquid filling apparatus includes a plurality of filling nozzles that have feed-out openings and opening-and-closing valves, valve actuating means which are installed at positions that correspond to the respective filling nozzles and which open and close the valves of the respective filling nozzles, a reservoir tank which stores a liquid, a liquid supplying means which is connected to the upstream side of the reservoir tank, an air pressure adjustment means which adjusts the air pressure inside the reservoir tank, liquid pipe channels which branch from the reservoir tank via a distribution chamber and is connected to the respective filling nozzles, and flow meters which are disposed in the branched liquid pipe channel so as to correspond to the respective filling nozzles.

Japanese Patent Application Laid-Open (Kokai) No. 11-193094 discloses a rotary type liquid filling apparatus.

This filling apparatus includes filling mechanisms which are disposed at fixed intervals in the circumferential direction on a rotating body that rotates continuously and fill containers with a liquid. The apparatus further includes a reservoir tank which stores the liquid, a liquid supplying means connected to the reservoir tank, a pressurizing means which pressurizes the interior of the reservoir tank, and liquid pipe channels which branch from the reservoir tank via a distribution chamber and are connected to the respective filling nozzles.

In this liquid filling apparatus, the pressure-adjustment valve of the pressurizing means is controlled on the basis of detection signals of a liquid pressure sensor that is installed adjacent to the reservoir tank so that air at a constant pressure is introduced into the reservoir tank. When it is detected by a liquid surface sensor that the liquid surface level inside the reservoir tank has dropped below a specified height, the liquid supplying means is actuated on the basis of the detection signal of this liquid surface level sensor so as to replenish the liquid inside the reservoir tank, thus maintaining the liquid pressure inside the reservoir tank and liquid pipe channels at a constant value.

Such liquid filling apparatuses include an apparatus in which flow meters corresponding to the respective filling nozzles are disposed in the branched liquid pipe channel. In this filling apparatus, the filling valves are opened as a result of the actuation of a valve actuating means at a specified timing by a control device at the time of filling, and the filling valves are closed as a result of the actuation of the valve actuating means by the control device at a point in time where the flow rate detected by the flow meters has reached a specified value, so that the amount of liquid with which the containers (e.g., bags) are filled is maintained at a constant value.

In cases where the liquid is flowing through the pipe channels at a certain flow velocity or greater, i.e., in cases where the valves are in a fully open state, the flow rate in the liquid pipe channels measured by such flow meters can be accurately measured even if the liquid pressure is not constant. However, when the valves open or close, it is difficult to achieve an accurate measurement of the flow rate (injection amount) of the liquid flowing through the pipe channels, since the flow velocity is small and varies abruptly. Furthermore, this flow rate fluctuates greatly with the liquid pressure. Accordingly, in a flow meter type liquid filling apparatus, it is necessary to maintain the liquid pressure in the vicinity of the filling nozzles at a constant value in order to maintain the amount of liquid with which the containers are filled (including the injection amount) at a constant value.

However, conventional flow meter type liquid filling apparatuses have problems as follows:

(1) Since the precision of the control of the air pressure in the reservoir tank by the pressurizing means is not very good (i.e., the air pressure inside the reservoir tank shows large fluctuations), it is difficult to maintain the liquid pressure at a constant value. Especially in the case of liquids that have a low viscosity, the liquid pressure used for filling must be set at a low value, so that the air pressure inside the reservoir tank must also be controlled to a low value. In such cases, however, control with good precision is achieved in a conventional apparatus.

(2) Even if the liquid pressure in the reservoir tank or in the liquid pipe channel adjacent to the reservoir tank is maintained at a constant value, the liquid pressure in the vicinity of the filling nozzles may not be constant. More specifically, the pressure loss caused by the resistance of the piping extending from the installation position of the liquid pressure sensor (i.e., the liquid pressure measurement position) to the filling nozzles increases with an increase in the viscosity of the liquid; and if the temperature of the liquid varies or the air temperature varies (e.g., between morning and noontime) so that the viscosity of the liquid varies, then the liquid pressure in the vicinity of the filling nozzles will fluctuate even in cases where the liquid pressure sensor shows the same liquid pressure.

(3) There are also problems in the detection precision itself of the liquid pressure detected by the liquid pressure sensor. In other words, in cases where the valves of a plurality of filling nozzles are successively opened and closed, an abnormal pressure is outputted as a result of the phenomenon of water hammer when the valves are closed. Furthermore, air contained in the liquid may remain in the position of the liquid pressure sensor, so that sharp accurate detection becomes impossible because of the compressibility of air.

SUMMARY OF THE INVENTION

Accordingly, the object of the present invention is to eliminate such problems in a conventional flow meter type liquid filling apparatus, so that the liquid pressure in the vicinity of the filling nozzles is maintained at a constant value, and the amount of liquid with which the containers are filled is maintained at a constant value.

The above object is accomplished by a unique structure for a flow meter type liquid filling apparatus that comprises:

- a plurality of filling nozzles each having a feed-out opening and a valve that opens and closes,
- a valve actuating means installed at a position that corresponds to each filling nozzle and opens and closes the valve of each filling nozzle,
- a reservoir tank which stores a liquid therein, a liquid supplying means connected to an upstream side of the reservoir tank, an air pressure adjustment means which adjusts air pressure inside the reservoir tank, a liquid pipe extending from the reservoir tank to a distribution chamber and then branched into liquid pipe channels each connected to each one of the filling nozzles, a liquid pressure sensor which detects a pressure of a liquid inside the liquid pipe, and a flow meter disposed on each one of the liquid pipe channels at a position that corresponds to each filling nozzle; wherein the air pressure adjustment means is actuated on the basis of a detection signal of the liquid pressure sensor, thus adjusting the air pressure inside the reservoir tank so that the pressure of the liquid inside the liquid pipe is maintained at a constant value, and the valve of each one of the filling nozzles is opened by the valve actuating means at a specified timing and is closed by the valve actuating means on the basis of the measurement signal of each one of the flow meters, thus filling containers with a fixed amount of a filling liquid; and wherein the air pressure adjustment means is comprised of:

a pressurized air supply source, an air supply amount control valve which is provided between the pressurized air supply source and the reservoir tank and controls the amount of pressurized air that is supplied to the reservoir tank, and an air discharge amount control valve which is connected to the reservoir tank and controls the amount of pressurized air that is discharged from the interior of the reservoir tank.

In this liquid filling apparatus, when the liquid pressure detected by the liquid pressure sensor is smaller than a set value (target value), the air supply amount control valve is opened; and when such a detected liquid pressure is larger than the set value (target value), then the air discharge amount control valve is opened. In the conventional apparatus, the air pressure inside the reservoir tank is controlled by a single control valve that is used for air supply. Accordingly, the amount of fluctuation in the air pressure is generally large, and a correction is unable in the case of overshooting. In the present invention, however, the air pressure inside the tank is precisely controlled by two control valves, i.e., one for air supply and one for air discharge. Thus, the liquid pressure inside the liquid pipe channel can be precisely controlled to a set value (target value). This is especially advantageous in the case of a low-viscosity liquid for which a lower air pressure is employed (in order to set the liquid pressure at a low value).

In order to accomplish a more precise control, it is desirable that the air supply amount control valve and air discharge amount control valve be proportional-control valves. A proportional-control valve is a valve in which its degree of opening is controlled in proportion to the inputted voltage. Such a valve can be controlled to an appropriate degree of opening so as to correspond to the magnitude of the detected value of the liquid pressure. In other word, the proportional-control valve is controlled to a degree of opening that is proportional to the dissociation width between, for instance, the detected value of the liquid pressure detected by the liquid pressure sensor and the set value (target value). As a result, when the dissociation width is small, the degree of opening is small, so that the fluctuation in the air pressure (and liquid pressure) is slight, and fine control is performed. On the other hand, when the dissociation width is large, then the degree of opening is large so that the liquid pressure quickly approaches the set value. In any event, with the use of proportional-control valves, the fluctuation width can be reduced, and a precise control is performed.

Another type of air pressure adjustment means of the present invention that makes a precise control on the air inside the reservoir tank is comprised of:

a pressurized air supply source, a plurality of air supply path provided in parallel between the pressurized air supply source and the reservoir tank, air supply path opening-and-closing valves that open and close the air supply paths a plurality of air discharge paths connected in parallel to the reservoir tank, air discharge path opening-and-closing valves that open and close the air discharge paths, and a control device that controls, based upon a detection signal of the liquid pressure sensor, an opening and closing operations of the air supply path opening-and-closing valves and discharge path opening-and-closing valves.

It is preferable that the air supply path opening-and-closing valves and the air discharge path opening-and-closing valves are electromagnetic valves. A setting as to which air supply path opening-and-closing valve and which air discharge path opening-and-closing valve is selected (so as to be opened) in response to the detection signal of the liquid pressure sensor is made in the control device. Based upon such a setting, the control device selects a particular air supply path opening-and-closing valve and air discharge path opening-and-closing valve that correspond to the detection signal of the liquid pressure sensor, thus opening the corresponding air supply path opening-and-closing valve and air discharge path opening-and-closing valve.

For instance, by way of providing throttle valves on the respective air supply path and air discharge path, the amount of air flow inside the air supply path and air discharge path is set by the throttle valve to be different from each other. When the dissociation width of the detected value of the liquid pressure sensor and the set value (target value) is large, the air supply path or the air discharge path that allow a larger flow amount is selected (in other word, the corresponding air supply path opening-and-closing valve or air discharge path opening-and-closing valve is opened). As a result, as in the case of the proportional-control valves, when the dissociation width is small, changes in the air pressure (and liquid pressure) is moderate, and a fine control is performed. On the other hand, when the dissociation width is large, then the liquid pressure becomes closer to the set value (target value). Thus, in either case, the changes in amount of fluctuation of the liquid pressure can be small, and a precise control is performed.

It is also possible to make such a setting that a plurality of air supply paths and air discharge paths are selected depending on necessity.

Furthermore, the flow meter type liquid filling apparatus of the present invention can be applied to a rotary type apparatus as seen in prior art. In this case, for example, the filling nozzles are disposed at fixed intervals in a plurality of locations in the circumferential direction on a rotating body which is attached to a hollow rotary shaft connected to a driving means and which rotates continuously, the flow meters and valve actuating means are rotated together with the filling nozzles, and a rotary joint is disposed in coaxial with the hollow rotary shaft so that the rotary joint forms a part of the liquid pipe channel, and the distribution chamber is formed on the rotatable lower section of this rotary joint.

The above object of the present invention is further accomplished by a still another unique structure for a flow meter type liquid filling apparatus that comprises:

- a plurality of filling nozzles each having a feed-out opening and a valve that opens and closes,
- a valve actuating means installed at a position that corresponds to each filling nozzle and opens and closes the valve of each filling nozzle,
- a reservoir tank which stores a liquid therein,
- a liquid supplying means connected to an upstream side of the reservoir tank,
- an air pressure adjustment means which adjusts air pressure inside the reservoir tank,
- a liquid pipe extending from the reservoir tank to a distribution chamber and then branched into liquid pipe channels each connected to each one of the filling nozzles,
- a liquid pressure sensor which detects a pressure of a liquid inside the liquid pipe, and
- a flow meter disposed on each one of the liquid pipe channels at a position that corresponds to each filling nozzle; wherein
  - the air pressure adjustment means is actuated on the basis of a detection signal of the liquid pressure sensor, thus adjusting the air pressure inside the reservoir tank so that the pressure of the liquid inside the liquid pipe is maintained at a constant value, and
  - the valve of each one of the filling nozzles is opened by the valve actuating means at a specified timing and is closed by the valve actuating means on the basis of a measurement signal of each one of the flow meters, thus filling containers with a fixed amount of a filling liquid; and wherein
    - the liquid pressure sensor is disposed on a distribution chamber or on a vertical portion that is a part of the liquid pipe and directly above the distribution chamber.

A plurality of liquid pipe channels branch toward the filling nozzles from the distribution chamber; accordingly, the distribution chamber is formed so as to have a larger cross-sectional area than the liquid pipe channel up to this point. As a result, there is a stagnation of the liquid flow in the distribution chamber, so that the flow velocity of the liquid is reduced, and the phenomenon of water hammer is alleviated here. Thus, an accurate detection is performed by the liquid pressure sensor. Furthermore, of the various locations in the liquid pipe channel where the liquid pressure sensor can be installed, the distribution chamber is positionally the closest to the filling nozzles; accordingly, the pressure loss caused by the piping resistance is correspondingly low, and the liquid pressure in the vicinity of the filling nozzles tends to be less affected by variations in the viscosity of the liquid.

Meanwhile, the accumulation of air in the vertical portion of the liquid pipe channel directly above the distribution chamber is prevented, and an accurate detection is performed by the liquid pressure sensor. Furthermore, since the liquid pressure sensor is disposed near the filling nozzles, this arrangement is advantageous in that the liquid pressure in the vicinity of the filling nozzles tends not to be affected by variations in the viscosity of the liquid.

Furthermore, the above-described flow meter type liquid filling apparatus of the present invention can also be suitably applied to a rotary type apparatus as seen in the prior art. In this case, for example, the filling nozzles are disposed at fixed intervals in a plurality of locations in the circumferential direction on a rotating body which is attached to a hollow rotary shaft connected to a driving means and which rotates continuously, the flow meters and valve actuating means are rotated together with the filling nozzles, and a rotary joint is disposed in coaxial with the hollow rotary shaft so that the rotary joint forms a part of the liquid pipe channel, and the distribution chamber is formed on the rotatable lower section of this rotary joint, while the liquid pipe channel is vertically connected to the fixed upper section of the rotary joint. When the liquid pressure sensor is disposed on the distribution chamber, the liquid pressure sensor is rotated together with the distribution chamber. However, when the liquid pressure sensor is disposed in the vertical portion of the liquid pipe channel, the liquid pressure sensor is not rotated.

In the flow meter type liquid filling apparatuses described above, it is desirable that a liquid surface level detection means which detects the liquid surface level inside the reservoir tank be provided. The liquid surface level detection means controls, by way of detection signals thereof, the liquid supplying means, thus maintaining the liquid surface level at a constant value. By maintaining the liquid surface level at a constant value, the volume of the head space (that is a space in which air is present) inside the reservoir tank is maintained at a constant value. As a result, the operation of the air pressure adjustment means in the head space can be maintained constantly, and a more stable control of the liquid pressure is performed. The reason for this is that since air is compressible, a large fluctuation in the volume of the head space is accompanied by a fluctuation in the effect of the same amount of air supply or discharge on the air pressure in the head space but this fluctuation can be suppressed.

Furthermore, in the above structure, the above-described liquid supply means is, in concrete terms, comprised of a pump, which is connected to the liquid supply source, and a liquid supply amount control valve, which is interposed between this pump and the reservoir tank; and the liquid supply amount control valve is controlled on the basis of the detection signal of the liquid surface level detection means. A proportional-control valve could be used as the liquid supply amount control valve. The function of the proportional-control valve is described above. Thus, the valve is controlled to an appropriate degree of opening corresponding to the magnitude of the detected value of the liquid surface level by, for instance, setting the degree of opening at a degree that is proportional to the dissociation width between the detected value and set value (target value) of the liquid surface level. As a result, the fluctuation width of the liquid surface level can be reduced, and a precise control is performed.

In the above structure, furthermore, it is desirable that the liquid pressure sensor be disposed between the above-described pump and the liquid supply amount control valve, thus controlling the number of revolution of the pump based upon the detection signal of the liquid pressure sensor. In concrete terms, the number of revolution of the pump is lowered when the liquid pressure sensor detects a high pressure, so that the pressure load on the pump and liquid is alleviated or eliminated. If the number of revolution of the pump is not lowered under a high pressure, the liquid is subjected to kneading by strong pressure load inside the pump, causing the liquid in the pump to have a volume increase and a change in composition.

DETAILED DSCRIPTION OF THE INVENTION

The flow meter type liquid filling apparatus of the present invention will be concretely described below with reference to FIGS. 1 through 4.

Figure 1:
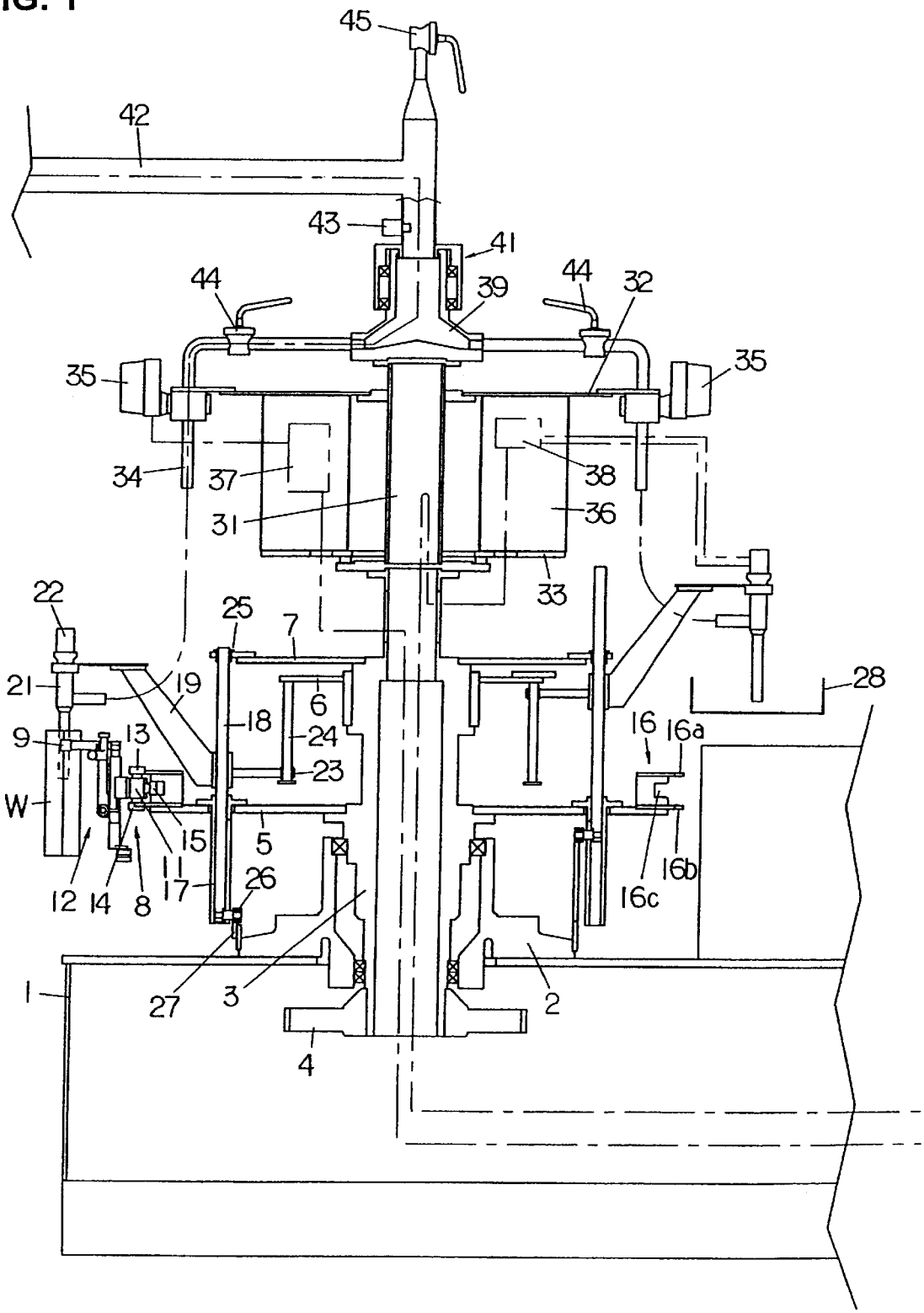
FIG. 1 is a sectional front view of the nozzle assembly of the flow meter type liquid filling apparatus according to the present invention.

The nozzle assembly of this flow meter type liquid filling apparatus is a rotary type. As shown in FIG. 1, a stand 2 is installed in an upright attitude on a base 1, and a hollow rotary shaft 3 is ratably supported on this stand 2. The hollow rotary shaft 3 is caused to rotate continuously by a driving means (not shown) via a gear 4 fastened to the lower end of the hollow rotary shaft 3.

A sprocket 5 and rotating tables 6 and 7 are fastened to the circumference of the hollow rotary shaft 3.

One end of an endless chain 8 is mounted on the sprocket 5, and a plurality of gripper pairs 9 that hold both edges of bags (containers) W are attached to this endless chain 8 at equal intervals. The gripper pairs 9 are thus moved along a horizontal racetrack-form path as the hollow rotary shaft 3 and sprocket 5 rotate. The endless chain 8 is formed by connecting a plurality of links 11 via connecting shafts in an endless configuration, and the gripper pairs 9 and operating mechanisms 12 that open and close the gripper pairs 9 (these operating mechanisms 12 are operated by a cam, etc., disposed along the movement path of the endless chain 8) are attached to the outside side surfaces of the respective links 11. Upper and lower rollers 13 and 14 are disposed on the connecting shafts, and inside rollers 15 are disposed on the insides of the links 11. The rollers 13 through 15 run over a guide member that is disposed along the movement path of the endless chain 8 in locations other than the sprocket 5. Meanwhile, the sprocket 5 has a tooth portion 16 formed by a ring-form member that is disposed on the circumference of the sprocket 5. Recessed portions 16*a* and 16*b* with which the upper and lower rollers 13 and 14 engage are formed at specified intervals in the tooth portion 16, and a groove 16*c* into which the inside rollers 15 are inserted is also formed in the tooth portion 16. The rotation of the sprocket 5 is transmitted to the endless chain 8 by the engagement of the upper and lower rollers 13 and 14 with the recessed portions 16*a* and 16*b*, so that the endless chain 8 is rotated.

Supporting tubes 17 which have grooves formed on their insides are disposed at equal intervals in intermediate positions on the sprocket 5. The supporting tubes 17 support raising-and-lowering shafts 18 so that the raising-and-lowering shafts can be freely raised and lowered. The rear end of an arm 19 which faces in the radial direction is fastened to each raising-and-lowering shaft 18, and a filling nozzle 21 and the valve actuating means (valve actuating air cylinder) 22 of this nozzle are fastened to the tip end of the arm 19. Furthermore, bushes 23 are fastened to the rear ends of the respective arms 19 via brackets. These bushes 23 are fitted over raising-and-lowering guides shafts 24 which are disposed at equal intervals on the circumference of the rotating table 6 so that these bushes 23 can slide. Furthermore, the upper portions of the raising-and-lowering shafts 18 are slidably guided by bushes 25 that are likewise disposed at equal intervals on the circumference of the rotating table 7.

Cam rollers 26 are attached to the lower ends of the raising-and-lowering shafts 18 via shaft members that can move upward and downward along the grooves of the supporting tubes 17, and the cam rollers 26 run over a nozzle raising-and-lowering cam 27 that is disposed on the circumference of the hollow rotary shaft 3.

The gripper pairs 9 (and bags W held thereby), which are conveyed by the endless chain 8, and the filling nozzles 21 are moved along circular-arc-form paths aligned above and below as the hollow rotary shaft 3 is rotated. During this movement, the filling nozzles 21 are lowered (and inserted into the bags W), stopped at the height of the bags (so that the bags are filled with a liquid here), and then raised (so that the filling nozzles are pulled out of the bags W) by the action of the cam rollers 26 and nozzle raising-and-lowering cam 27.

The reference numeral 28 refers to a receiving dish used to recover the cleaning liquid during the cleaning of the liquid pipe channels, filling nozzles, etc.

An air tank 31 is concentrically fastened to the upper portion of the hollow rotary shaft 3, and rotating tables 32 and 33 are fastened to its circumference. Liquid pipe channels 34 (that branch out from the liquid pipe 42) for supplying the liquid to the respective filling nozzles 21 are attached to the rotating table 32, and electromagnetic flow meters 35 are attached to the respective liquid pipe channels 34. Also, inside an annular accommodating box 36 which is disposed between the rotating tables 32 and 33, sequencers 37 and electromagnetic opening-and-closing valves 38 are disposed so as to positinnally correspond to the respective electromagnetic flow meters 35 and valve actuating air cylinders 22.

Each sequencer 37 receives a pulse signal from the corresponding electromagnetic flow meter 35. At the point in time at which this pulse signal reaches a specified value, the sequencer 37 sends a control signal to the corresponding electromagnetic opening-and-closing valve 38 and actuates this valve 38, so that pressurized air inside the air tank 31 is sent to the corresponding valve actuating air cylinder 22. As a result, the valve of the corresponding filling nozzle 21 is closed, and the discharge supply of liquid is stopped.

In addition, wiring (not shown) for the power supply (not shown) of the respective sequencers 37 and electromagnetic opening-and-closing valves 38 and control wiring connected to an external control device (not shown), as well as piping for the pressurized air of the air tank 31, etc., is connected between the inside and outside of the hollow rotary shaft 3 via slip rings.

A distribution chamber 39 having an expanded cross section is disposed on the upper portion of the air tank 31 so as to be coaxial with the hollow rotary shaft 3 and is rotated together with the hollow rotary shaft 3. The distribution chamber 39 communicates with a liquid pipe 42 (fixed side) via a rotary joint 41 that is coaxial with the hollow rotary shaft 3. Furthermore, a plurality of liquid pipe channels 34 are connected to the circumference of the distribution chamber 39 (in other words, the liquid pipe 42 is branched into plurality of liquid pipe channels 34), and these liquid pipe channels 34 communicate with the respective filling nozzles 21. The liquid pipe 42 has a vertical portion directly above the rotary joint 41, and a liquid pressure sensor 43 that measures the pressure of the liquid is disposed on this vertical portion.

In FIG. 1, the reference numerals 44 refer to manual flow passage opening-and-closing valves that are disposed in the respective liquid pipe channels 34, and the reference numeral 45 refers to an opening-and-closing valve used for air venting.

Control of the amount of filling of liquid by the filling nozzles 21 into the nozzle assembly shown in FIG. 1 is accomplished in the following manner:

(1) When the respective filling nozzles 21 are rotated continuously by the continuous rotation of the hollow rotary shaft 3 at a constant speed, the external control device (not shown) sends control signals to the electromagnetic opening-and-closing valves 38 provided for the respective filling nozzles 21 at a preset specified timing (e.g., such a timing being at the time when each filling nozzle 21 reaches a specified position on the circular nozzle traveling path). As a result, the valves 38 are actuated. Accordingly, pressurized air inside the air tank 31 is sent to the valve actuating air cylinders 22, thus opening the valves of the filling nozzles 21 so that the supply of the liquid is initiated.

(2) At the same time, the flow meters 35 for the respective filling valves 21 send pulse signals that correspond to the flow rate to the respective sequencers 37.

(3) At a point in time at which the pulse signals from the flow meters 35 reach a specified value, the sequencers 37 send control signals to the corresponding electromagnetic opening-and-closing valves 38 so that the valves 38 are actuated in reverse. As a result, the valve actuating air cylinders 22 are actuated in reverse, and the valves of the filling nozzles 21 are closed, thus stopping the supply of the liquid to the filling nozzles 21.

Figure 2:
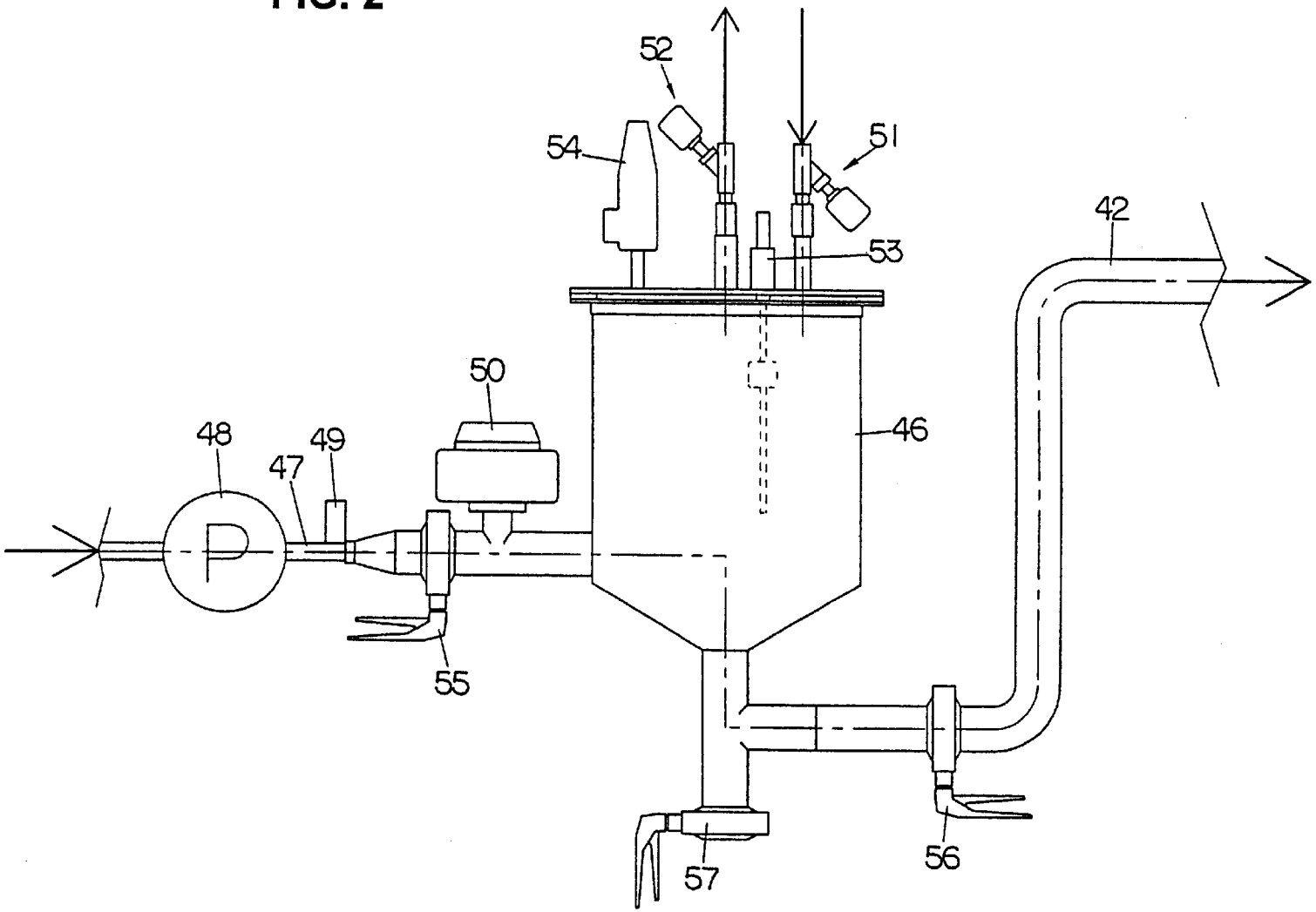
FIG. 2 is a front view of the tank assembly thereof.

FIG. 2 shows a tank assembly which is disposed on the upstream side of the liquid pipe 42. The tank assembly supplies the liquid to the nozzle assembly shown in FIG. 1. The tank assembly is comprised of a reservoir tank 46, a liquid supply pipe 47 which is connected to a liquid supply source (not shown) that is disposed on the upstream side of the reservoir tank 46, a pump 48 which is disposed in the liquid supply pipe 47, a liquid pressure sensor 49 and a liquid supply amount control valve 50. The liquid supply pipe 47, pump 48, liquid pressure sensor 49 and liquid supply amount control valve 50 constitute the liquid supplying means of the present invention.

The reservoir tank 46 includes an air supply amount control valve 51 which is connected to a pressurized air supply source (not shown), an air discharge amount control valve 52, a liquid surface level gauge 53 which is a float inside the reservoir tank 46 and detects the liquid surface level, and a safety valve 54 which opens when the pressure inside the head space of the reservoir tank reaches a specified value or greater. The air supply amount control valve 51, air discharge amount control valve 52 and liquid supply amount control valve 50 are all proportional-control valves. In FIG. 2, the reference numerals 55 and 56 refer to manual flow passage opening-and-closing valves, and the reference numeral 57 refers to a waste liquid opening-and-closing valve that is manually operated.

Figure 3:
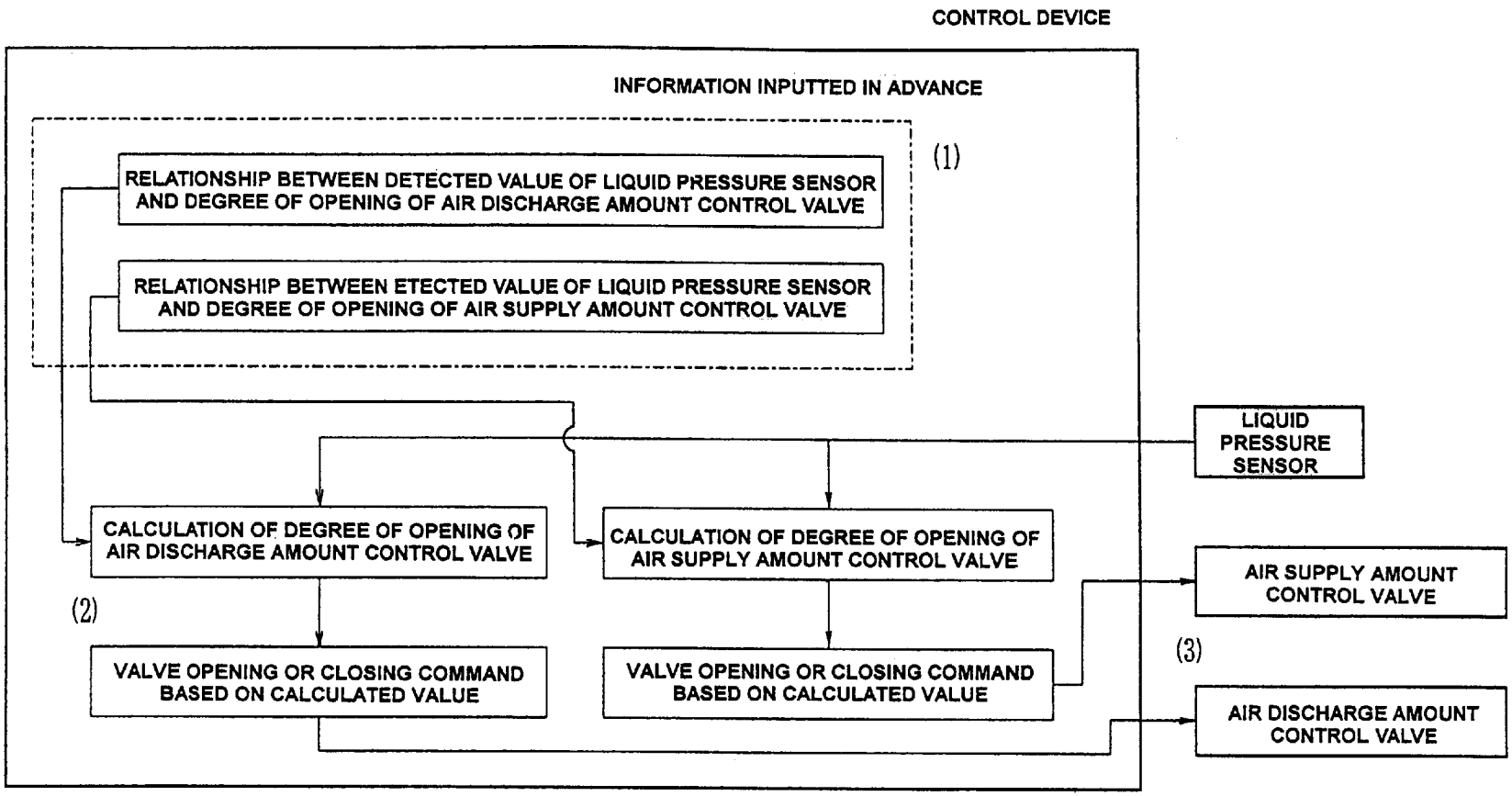
FIG. 3 is a diagram illustrating the control method of the air supply amount control valve and air discharge amount control valve of the reservoir tank.

The air pressure inside the reservoir tank 46 of the tank assembly shown in FIG. 2 is controlled by the air supply amount control valve 51 and air discharge amount control valve 52 so that the liquid pressure detected by the liquid pressure sensor 43 (see FIG. 1) is maintained at a certain set value (target value) as described below (see FIG. 3).

(1) A presetting is made in the control device for the relationship between the liquid pressure detected by the liquid pressure sensor 43 and the degree of opening of the air supply amount control valve 51 (e.g., the degree of opening is zero when the detected value is equal to or greater than the set value (target value), and the degree of opening is larger as the dissociation width increases when the detected value is smaller than the set value) and for the relationship between the liquid pressure detected by the liquid pressure sensor 43 and the degree of opening of the air discharge amount control valve 52 (e.g., the degree of opening is zero when the detected value is equal to or smaller than the set value, and the degree of opening is larger as the dissociation width increases when the detected value is greater than the set value (target value).

(2) When the detection signal of the liquid pressure sensor 43 enters the control device, the control device calculates the degrees of opening of the air supply amount control valve 51 and air discharge amount control valve 52 based upon this signal and sends opening or closing command signals to the respective valves.

(3) The degrees of opening of the air supply amount control valve 51 and air discharge amount control valve 52 are adjusted in accordance with the opening or closing command signals of the control device.

Meanwhile, the liquid surface level inside the reservoir tank 46 is controlled to a constant value by the liquid supply amount control valve 50 in the following manner:

(1) A presetting is made in the control device for the relationship between the liquid surface level detected by the liquid surface level gauge 53 and the degree of opening of the liquid supply amount control valve 50 (e.g., the degree of opening is zero when the detected value is equal to or greater than the set value (target value), and the degree of opening is larger as the dissociation width increases when the detected value is smaller than the set value).

(2) When the detection signal of the liquid surface level gauge 53 enters the control device, the control device calculates the degree of opening of the liquid supply amount control valve 50 based upon this signal and sends out an opening or closing command signals to the valve.

(3) The degree of opening of the liquid supply amount control valve 50 is adjusted in accordance with the opening or closing command signals of the control device.

The number of revolution of the pump 48 is controlled on the basis of the detection signal of the liquid pressure sensor 49. In concrete terms, the relationship between the value detected by the liquid pressure sensor 49 and the number of revolution of the pump 48 (a relationship which is such that the number of revolution of the pump is lowered as the detected liquid pressure increases) is set in advance. Alternatively, instead of making a control based upon the detection signal of the liquid pressure sensor 49, the number of revolution can be controlled on the basis of the degree of opening of the control valve 50. In concrete terms, the relationship between the degree of opening of the liquid supply amount control valve 50 and the number of revolution of the pump 48 (a relationship which is such that the number of revolution of the pump is lowered as this degree of opening decreases) is in advance.

Figure 4:
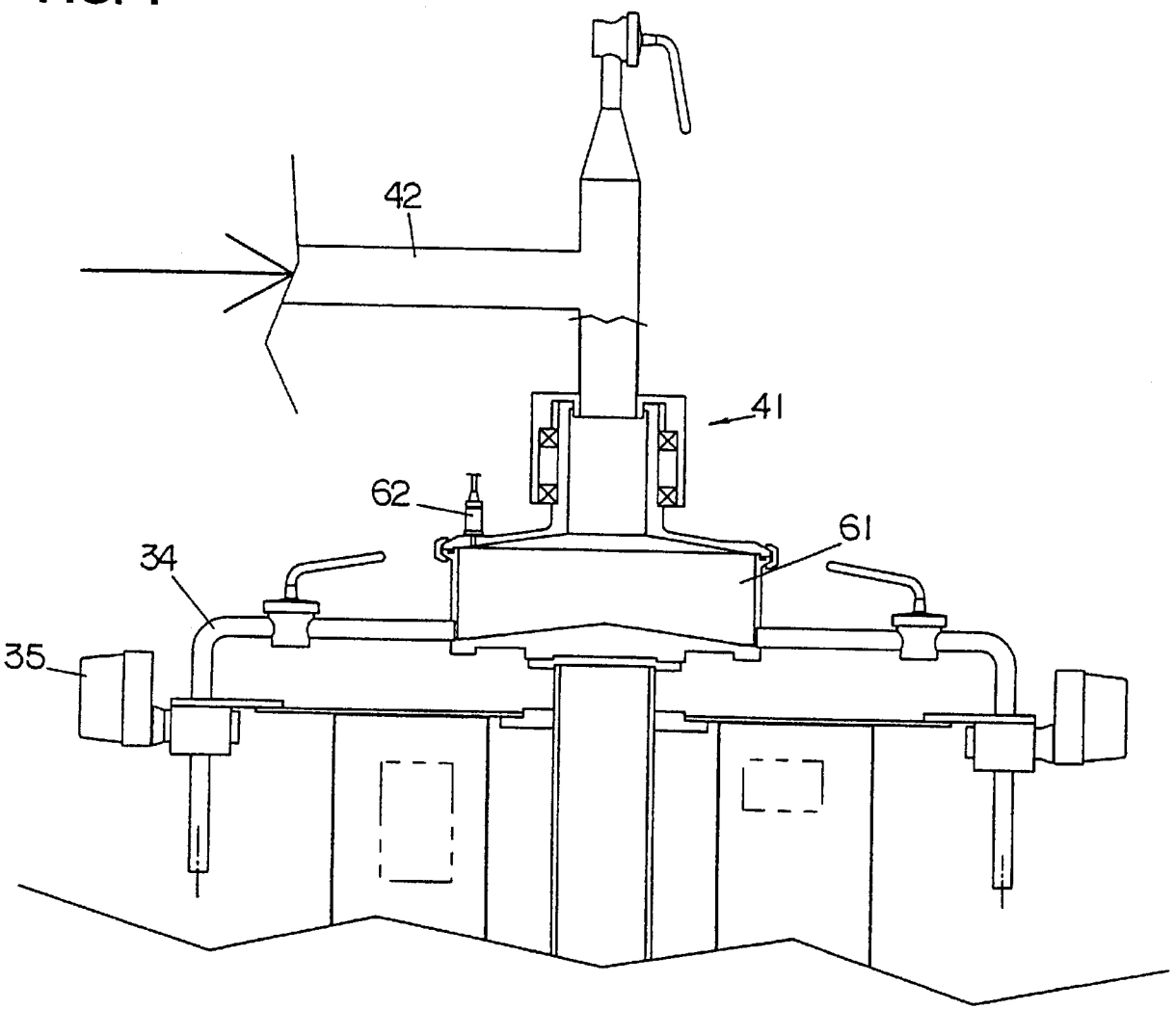
FIG. 4 is a sectional front view of the nozzle assembly of another type of flow meter type liquid filling apparatus according to the present invention.

FIG. 4 shows another flow meter type liquid filling apparatus (nozzle assembly) of the present invention. This filling apparatus differs from the filling apparatus shown in FIG. 1 in that the distribution chamber 61 is larger so that a liquid pressure sensor 62 is disposed in the distribution chamber 61. Elements that are the same as those in FIG. 1 are labeled with the same reference numerals.

With the arrangement of FIG. 4, the liquid pressure can be detected at a location that is closer to the filling nozzles 21 (see FIG. 1) than in the filling apparatus of FIG. 1. Also, the flow velocity of the liquid is smaller. Accordingly, the detection is more accurate.

Figure 5:
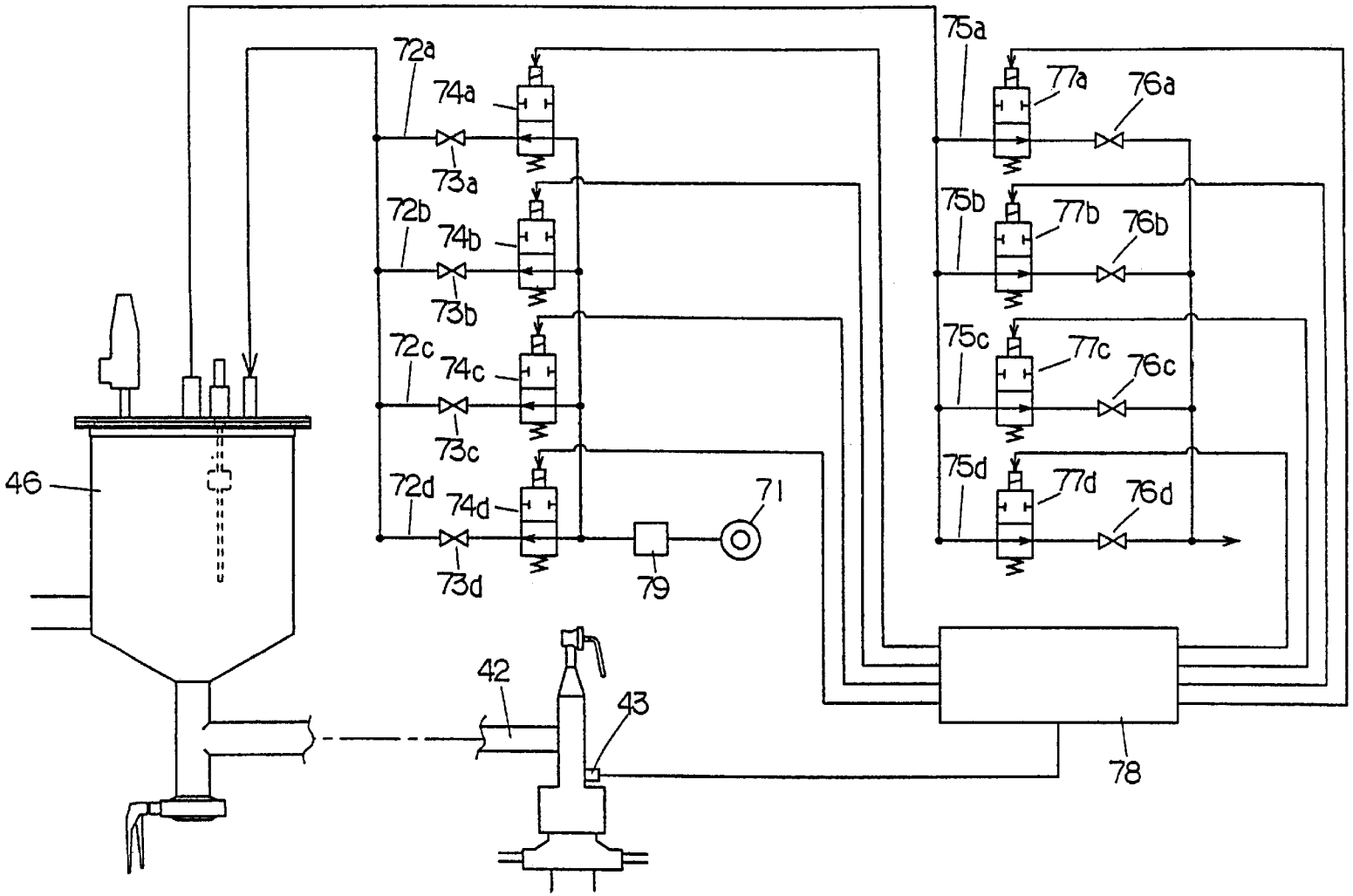
FIG. 5 is a sectional front view of an air pressure adjustment means used in the flow meter type liquid filling apparatus of the present invention.

FIG. 5 shows another embodiment of the present invention. In this embodiment, the above-described air pressure adjustment means (the air supply amount control valve 51 and the air discharge amount control valve 52) employed in the flow meter type liquid filling apparatus shown in FIGS. 1 and 2 is replaced with another type of air pressure adjustment means (In FIG. 5, the same elements as those in FIGS. 1 and 2 are given with the same reference numerals).

More specifically, the air pressure adjustment means in FIG. 5 is comprised of an pressured air supply source (compressor) 71, four air supply paths 72*a*, 72*b*, 72*c* and 72*d* provided in parallel between the pressured air supply source 71 and the reservoir tank 46, throttle valves 73*a*, 73*b*, 73*c* and 73*d* and air supply path opening-and-closing valves 74*a*, 74*b*, 74*c* and 74*d* (such valves being electromagnetic valves and normally opened) each mounted on the respective air supply paths 72*a*, 72*b*, 72*c* and 72*d*.

The air pressure adjustment means of FIG. 5 further includes four air discharge paths 75*a*, 75*b*, 75*c* and 75*d* connected in parallel to the reservoir tank 46, throttle valves 76*a*, 76*b*, 76*c* and 76*d* and air discharge path opening-and-closing valves 77*a*, 77*b*, 77*c* and 77*d* (such valves being electromagnetic valves and normally closed) each mounted on the respective air discharge paths 75*a*, 75*b*, 75*c* and 75*d*.

The air pressure adjustment means further includes a control device 78 that controls, based upon the detection signal of the liquid pressure sensor 43, the open and close actions of the air supply path opening-and-closing valves 74*a*, 74*b*, 74*c* and 74*d* and air discharge path opening-and-closing valves 77*a*, 77*b*, 77*c* and 77*d*. The tip ends of the throttle valves 76*a*, 76*b*, 76*c* and 76*d* are formed into a single tube that opens to the atmosphere at the opening 76*e*.

In FIG. 5, the reference numeral 79 is an electropneumatic regulator (a regulator adjusting air pressures by electric signals) that adjusts the pressure of the air discharged by the compressor 71. The electropneumatic regulator 79 also makes a part of the air pressure adjustment means of FIG. 5.

In this air pressure adjustment means, the throttle valves 73*a*, 73*b*, 73*c* and 73*d* are adjusted so that the flow amount of the air in the air supply paths becomes larger in the order of the air supply path 72*a*→the air supply path 72*b*→the air supply path 72*c*→the air supply path 72*d*; on the other hand, the throttle valves 76*a*, 76*b*, 76*c* and 76*d* are adjusted so that the flow amount of the air in the air discharge paths becomes larger in the order of the air discharge path the air discharge path 75*a*→the air discharge path 75*b*→the air discharge path 75*c*→the air discharge path 75*d*.

Figure 6:
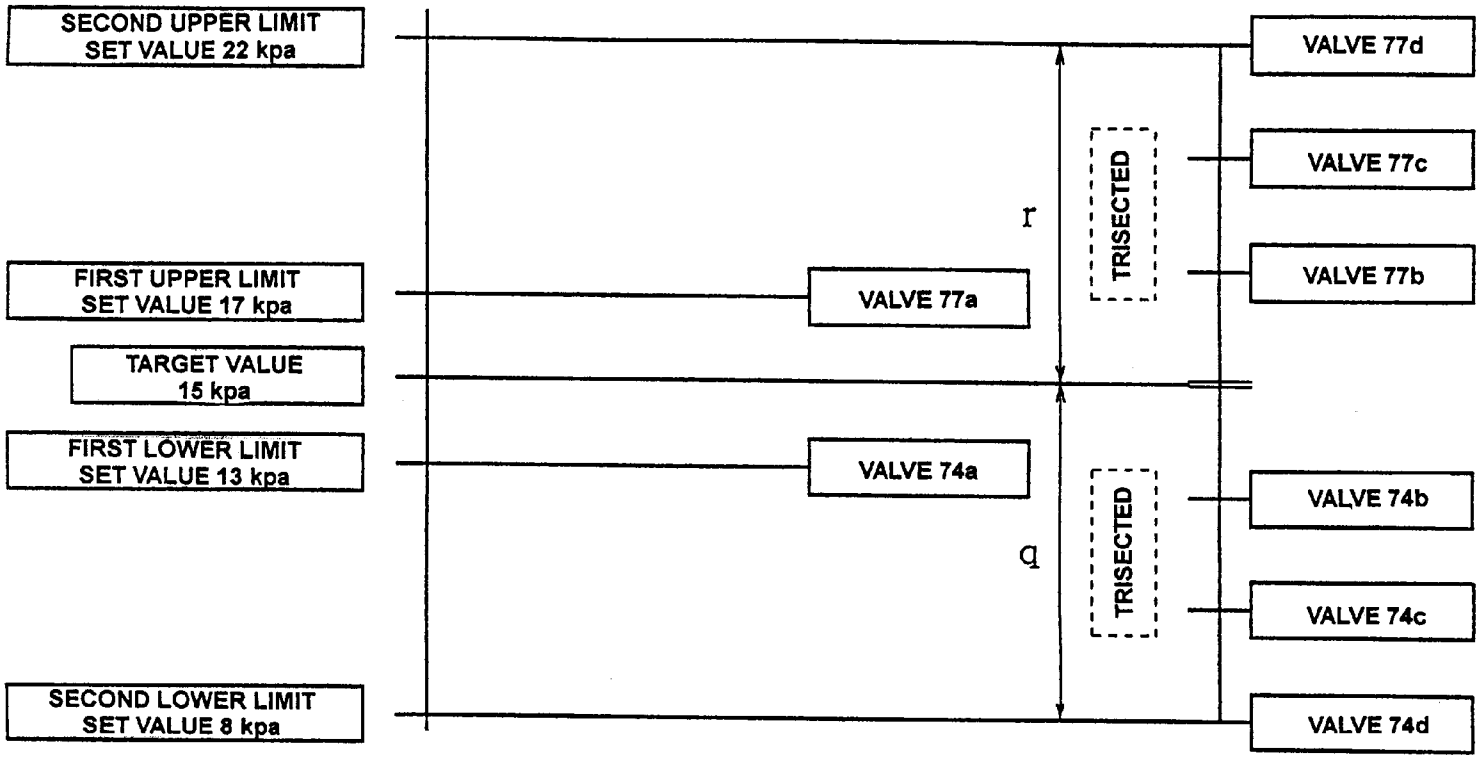
FIG. 6 is a diagram illustrating the control method of the air pressure adjustment means of FIG. 5.

Also, the relationship between the liquid pressure detected by the liquid pressure sensor 43 and the open action of the air supply path opening-and-closing valves 74*a*, 74*b*, 74*c* and 74*d* and air discharge path opening-and-closing valves 77*a*, 77*b*, 77*c* and 77*d* executed by the control device 78 is set in the following manner (see FIG. 6) (The present invention should not be limited to the example described below).

(1) The target value of the liquid pressure detected by the liquid pressure sensor 43 is set to be 15 kpa. When the liquid pressure is between the first lower limit set value 13 kpa and the first upper limit set value 17 kpa, then all the air supply path opening-and-closing valves 74*a*, 74*b*, 74*c* and 74*d* and the air discharge path opening-and-closing valves 77*a*, 77*b*, 77*c* and 77*d* are closed; and thus the air is not supplied or exhausted.

(2) When the liquid pressure detected by the liquid pressure sensor 43 decreases so that the first lower limit set value becomes 13 kpa, then the air supply path opening-and-closing valve 74*a* is opened (when the air supply path 72*a* is selected). Conversely, when the liquid pressure detected by the liquid pressure sensor 43 increases so that the first upper limit set value becomes 17 kpa, then the air discharge path opening-and-closing valve 77*a* is opened (when the air discharge path 75*a* is selected).

(3) When the liquid pressure detected by the liquid pressure sensor 43 reaches to the second lower limit set value 8 kpa, then the air supply path opening-and-closing valve 74*d* is opened (when the air supply path 72*d* is selected). Conversely, when the liquid pressure detected by the liquid pressure sensor 43 reaches to the second upper limit set value 22 kpa, then the air discharge path opening-and-closing valve 77*d* is opened (when the air discharge path 75*d* is selected).

(4) The pressure difference q of the target value 15 kpa and the second lower limit set value 8 kpa is trisected; and when the liquid pressure detected by the liquid pressure sensor 43 decreases by the value of q/3 than the target value, then the air supply path opening-and-closing valve 74*b* is opened (when the air supply path 72*b* is selected). When the liquid pressure detected by the liquid pressure sensor 43 decreases by the amount of 2q/3 than the target value, then air supply path opening-and-closing valve 74*c* is opened (when the air supply path 72*c* is selected). Also, the pressure difference r of the target value 15 kpa and the second upper limit set value 22 kpa is trisected; and when the liquid pressure detected by the liquid pressure sensor 43 increases by the value of r/3 than the target value, then the air discharge path opening-and-closing valve 77*b* is opened (when the air discharge path 75*b* is selected). When the liquid pressure detected by the liquid pressure sensor 43 increases by the value of 2r/3 than the target value, then the air discharge path opening-and-closing valve 77*c* is opened (when the air discharge path 75*c* is selected).

In the above air pressure adjustment means of FIG. 5, the air supply path opening-and-closing valves 74*a*, 74*b*, 74*c* and 74*d* and the air discharge path opening-and-closing valves 77*a*, 77*b*, 77*c* and 77*d* are electromagnetic valves and thus react immediately to the control signal outputted by the control device 78. Accordingly, a selection of air supply paths or air discharge paths that correspond to the liquid pressure detected by the liquid pressure sensor can be made quickly. In other words, the air supply speed or air discharge speed corresponds to the liquid pressure detected by the liquid pressure sensor is obtained quickly. Accordingly, even at the time of start of filling of the liquid into containers and of completion of filling in which the amount of fluctuation of the liquid presser tends to be high and the dissociation width relative to the target value tends to abruptly increase, the liquid pressure can be brought to a closer value to the target value, thus refraining the changes in the liquid pressure.

In the above second embodiment, the flow amount of the air inside the air supply paths 72*a*, 72*b*, 72*c* and 72*d* and the air discharge paths 75*a*, 75*b*, 75*c* and 75*d* is changed by way of changing the amount of opening of the throttle valves 73*a*, 73*b*, 73*c* and 73*d* and 76*a*, 76*b*, 76*c* and 76*d*. Also, the air supply speed to the reservoir tank 46 and the air discharge speed from the reservoir tank 46 is controlled by way of selecting one of the air supply paths 72*a*, 72*b*, 72*c* and 72*d* and the air discharge paths 75*a*, 75*b*, 75*c* and 75*d*. However, the same effect is obtainable by an employment of pipes that differ in their inner diameters instead of the described throttle valves.

Furthermore, in the above second embodiment, any one of the air supply paths 72*a*, 72*b*, 72*c* and 72*d* and the air discharge paths 75*a*, 75*b*, 75*c* and 75*d* is set so as to be selected. However, it can be set so that two or more air supply paths 72*a*, 72*b*, 72*c* and 72*d* and two or more air discharge paths 75*a*, 75*b*, 75*c* and 75*d* are selected. For instance, it can be set so that the air supply path 72*a* is selected at the first lower limit set value; and when the liquid pressure decreases by q/3 than the target value, the air supply path 72*b* is additionally selected; and when the liquid pressure decreases by 2q/3 than the target value, then the air supply path 72*c* is further selected; and also all the air supply paths 72*a*, 72*b*, 72*c* and 72*d* are selected at the second lower limit set value. The selections can be set freely as desired. When a plurality of flow paths are selected simultaneously depending on the liquid pressure, it is not necessary that the flow amount in each of the air supply paths 72*a*, 72*b*, 72*c* and 72*d* or the flow amount in each of the air discharge paths 75*a*, 75*b*, 75*c* and 75*d* is different from each other.

As a matter of course, the number of the air supply path and air discharge path is not limited to four.

The liquid filling apparatus of the present invention is a flow meter type apparatus; accordingly, even if there is a fluctuation in the number of filling nozzles that discharge the liquid among the plurality of filling nozzles, the amount of liquid with which the containers are filled can be fixed at a constant amount as long as the liquid pressure inside the liquid pipe channels is constant. Furthermore, in the present invention, the liquid pressure sensor is disposed near the nozzles, and the system is arranged so that the liquid pressure in this area is maintained at a constant value. Accordingly, the pressure loss caused by the resistance of the piping extending to the filling nozzles is small, and variations in the viscosity of the liquid tend to have little effect, so that more accurate control of the filling amount is possible.

Furthermore, the air pressure inside the reservoir tank is controlled in order to maintain the liquid pressure inside the liquid pipe channels at a constant value; since this air pressure is controlled by two control valves, i.e., an air supply amount control valve and an air discharge amount control valve, or by a plurality of air supply path and air supply path opening-and-closing valves that supply air and a plurality of air discharge paths and air discharge path opening-and-closing valves that discharge air, the air pressure inside the reservoir tank can be precisely controlled, so that the liquid pressure inside the liquid pipe channels can be precisely controlled to a target value.

Furthermore, if the apparatus is arranged so that the liquid surface level inside the reservoir tanks is maintained at a constant value, control of the liquid pressure can be made much more stable.

What is claimed is:

1. A flow meter type liquid filling apparatus comprising:

a plurality of filling nozzles each having a feed-out opening and a valve that opens and closes, a valve actuating means installed at a position that corresponds to each one of said filling nozzles and opens and closes said valve of each one of said filling nozzles, a reservoir tank which stores a liquid therein, a liquid supplying means connected to an upstream side of said reservoir tank, an air pressure adjustment means which adjusts air pressure inside said reservoir tank, a liquid pipe extending from said reservoir tank to a distribution chamber and then branched into liquid pipe channels each connected to each one of said filling nozzles, a liquid pressure sensor which detects a pressure of a liquid inside said liquid pipe, and a flow meter disposed on each one of said liquid pipe channels at a position that corresponds to said each one of said filling nozzles; wherein said air pressure adjustment means is actuated on the basis of a detection signal of said liquid pressure sensor, thus adjusting said air pressure inside said reservoir tank so that said pressure of said liquid inside said liquid pipe is maintained at a constant value, and said valve of each one of said filling nozzles is opened by said valve actuating means at a specified timing and is closed by said valve actuating means on the basis of a measurement signal of each one of said flow meters, thus filling containers with a fixed amount of a filling liquid; and wherein said air pressure adjustment means is comprised of:

a pressurized air supply source, a plurality of air supply paths provided in parallel between said pressurized air supply source and said reservoir tank, air supply path opening-and-closing valves that open and close said air supply paths, a plurality of air discharge paths connected in parallel to said reservoir tank, air discharge path opening-and-closing valves that open and close said air discharge paths, and a control device that controls, based upon a detection signal of said liquid pressure sensor, an opening and closing operations of said air supply path opening-and-closing valves and said discharge path opening-and-closing valves.

2. The flow meter type liquid filling apparatus according to claim 1, wherein said flow meter type liquid filling apparatus is a rotary type apparatus, and wherein said filling nozzles are disposed at fixed intervals on a rotating body in a plurality of locations in a circumferential direction, said rotating body being attached to a rotary shaft connected to a driving means and rotating continuously;

said flow meter and valve actuating means being rotated together with said filling nozzles, a rotary joint is disposed coaxially with said rotary shaft so that said rotary joint forms a part of said liquid pipe, and said distribution chamber is disposed on a rotatable lower section of said rotary joint.

3. The flow meter type liquid filling apparatus according to claim 2, further comprising a liquid surface level detection means that detects a liquid surface level inside said reservoir tank, wherein said liquid supplying means is controlled in accordance with a detection signal of said liquid surface level detection means, thus maintaining said liquid surface level at a constant value.

4. The flow meter type liquid filling apparatus according to claim 1, further comprising a liquid surface level detection means that detects a liquid surface level inside said reservoir tank, wherein said liquid supplying means is controlled in accordance with a detection signal of said liquid surface level detection means, thus maintaining said liquid surface level at a constant value.

* * * * *